US006347650B1

(12) United States Patent
Affleck et al.

(10) Patent No.: US 6,347,650 B1
(45) Date of Patent: Feb. 19, 2002

(54) DEVICE AND METHOD FOR DISPENSING PARTICULATE MATERIAL

(75) Inventors: Rhett Affleck, Poway; Thuc Nguyen, San Diego; Rob Neeper, Lakeside, all of CA (US)

(73) Assignee: Discovery Partners International, Inc., San Diego, CA (US)

( * ) Notice: Subject to any disclaimer, the term of this patent is extended or adjusted under 35 U.S.C. 154(b) by 0 days.

(21) Appl. No.: 09/595,665

(22) Filed: Jun. 16, 2000

(51) Int. Cl.[7] ..... B65B 1/00

(52) U.S. Cl. ..... 141/181; 141/1; 141/46; 141/12; 141/59; 141/62; 141/65; 141/67; 141/87; 141/152; 141/173

(58) Field of Search ..... 141/1, 11, 12, 141/46, 59, 62, 65, 67, 71, 81, 129, 145–147, 152, 173, 177, 181, 258; 222/306–329

(56) References Cited

U.S. PATENT DOCUMENTS

| | | | | |
|---|---|---|---|---|
| 3,656,517 A | * | 4/1972 | Taylor et al. | 141/1 |
| 3,656,518 A | | 4/1972 | Aronson | 141/1 |
| 3,847,191 A | * | 11/1974 | Aronson | 141/12 |
| 4,185,669 A | * | 1/1980 | Jevakohoff | 141/59 |
| 4,640,448 A | | 2/1987 | Trechsel | 222/636 |
| 4,751,948 A | | 6/1988 | Hertig et al. | |
| 4,949,766 A | | 8/1990 | Coatsworth | 141/67 |
| 4,976,296 A | * | 12/1990 | Pope | 141/46 |
| 5,598,876 A | | 2/1997 | Zanini et al. | |
| 5,626,171 A | * | 5/1997 | Mirri | 141/152 |
| 5,722,470 A | | 3/1998 | Kedar et al. | |
| 5,727,607 A | | 3/1998 | Ichikawa et al. | |
| 5,916,526 A | | 6/1999 | Robbins et al. | |
| 5,961,923 A | | 10/1999 | Nova et al. | 422/68.1 |

FOREIGN PATENT DOCUMENTS

| | | |
|---|---|---|
| WO | WO 97/17258 | 5/1997 |
| WO | WO 97/40383 | 10/1997 |
| WO | WO 00/44490 | 8/2000 |

* cited by examiner

*Primary Examiner*—J. Casimer Jacyna
(74) *Attorney, Agent, or Firm*—Brown, Martin, Haller & McClain

(57) ABSTRACT

The resin dispenser comprises a support frame, a probe with an adjustable loading volume mounted on the support frame and connected to a vacuum source, a hopper for containing a resin slurry, a holder for retaining one or more containers to be loaded at a loading position, a translation means for moving the probe from the hopper to the container, a fluid circulation pump and an air pump for circulating fluid in the hopper, and at least one control device. The hopper includes a means for continuous circulation and replenishment of solvent with a large reserve of resin, and has a small volume from which the resin is extracted. The method for dispensing comprises drawing resin from a dispenser trough in the hopper into the loading volume using a vacuum, moving the probe to the loading position, then activating an air actuator which expels a resin pellet from the probe into the container by initiating movement of the inner and outer tubes that define the loading volume.

33 Claims, 3 Drawing Sheets

DEVICE AND METHOD FOR DISPENSING PARTICULATE MATERIAL

FIELD OF THE INVENTION

The invention relates to a system and method for dispensing particulate material, and more particularly to a system and method for dispensing of particulate solid supports into containers for use in solid-phase chemical or biological processes.

BACKGROUND OF THE INVENTION

In recent years, the pharmaceuticals industry has devoted significant resources to finding ways to cut the time required for identification and evaluation of lead drugs. Disciplines that have arisen to address this need include high-throughput screening and combinatorial chemistry. Using combinatorial methods, libraries made up of large numbers of compounds are randomly or semi-randomly synthesized, then evaluated using high-throughput screening, looking for biological activity or chemical reactions. The availability of solid-phase supports, e.g., resin beads, balls, disks or tubes, for organic synthesis has contributed significantly to the ability to create large combinatorial libraries, making it possible to synthesize a unique compound on each support.

One configuration of solid support that has become widely accepted is that of a porous container which contains a plurality of resin beads, particles or powder grains that are larger than the pores of the container. Solutions can pass through the walls of the container and readily interact with the particles while the particles are retained within the container. An example of such solid supports is provided in U.S. Pat. No. 5,961,923, assigned to the assignee of the present application. The disclosure of the '923 patent is incorporated herein by reference.

In cases where the container is quite small, in order to maximize the amount of compound that can be synthesized on the beads, one needs to use the largest possible volume of beads that can be held in the container. On the other hand, considerations must be made for swelling of the resin beads as compounds are synthesized, taking care to avoid having the beads swell to completely fill, or exceed the volume of, the container, possibly bursting the container, or causing the beads to become so densely packed that solutions cannot readily flow among them and the surface area available for interaction is greatly reduced.

Conventional methods of dispensing resin generally involve the handling of dry resin, which can be performed by manual or automated volumetric operations. One example of a manually-loaded dry resin system is the FLEXCHEM™ Flip Resin Loader by Robbins Scientific Corporation (Sunnyvale, Calif.). Dry resin is evenly spread across the surface of a resin loader to fill a plurality of depressions which correspond in number and layout to the number of wells in a multi-well plate. Excess resin is swept off the end into a source container so that each depression is filled flush with the surface. The multi-well plate is fitted to the top of the loader and the block is inverted so that the resin is transferred from the loader to the wells, relying on gravity to complete the transfer.

Automated loaders of dry particulate material are well known, particularly in pharmaceutical applications of filling capsules for oral administration of medication. One such loader that has been widely used is described in U.S. Pat. No. 3,656,518. This loader utilizes a dispensing wheel that rotates on a horizontal axis and has a plurality of radially-distributed chambers of known volume. The chambers are filled with powder from a hopper located above the wheel and release the powder into a container below the wheel when the wheel is rotated 180° to a discharge position. Gravity, alone or in combination with air pressure, cause the powder to be released from the chamber and into the waiting container.

Because dry resin is very fine-grained, air currents generated by the movement of the handlers and equipment can scatter the resin out of the container. This scattering can be exacerbated if air pressure is used to expel the small particles. Additional problems encountered with using this type of dispensing system include sticky or clumped resin caused by small amounts of moisture in otherwise dry resin, loss of resin due to static cling, loss of resin due to spillage, bead breakage, and contamination of surrounding equipment and surfaces by stray resin particles. Furthermore, when the resin is pre-functionalized with chemical moieties it can be very sticky, such that the "dry" resin is not free-flowing but clumped together, making accurate volumetric dispensing difficult. These problems can result in less accurate, and more time-consuming loading procedures.

Wet resin dispensing has been used to overcome some of the apparent problems with dry resin dispensing. For example, where the resin is sticky and tends to clump together, a solvent can be used to reduce bead-to-bead attraction. Typically, wet resin dispensing involves use of an isobuoyant solution consisting of resin suspended in a liquid of approximately equal density to maintain a mostly homogenous distribution of resin through the solution, i.e., a slurry. The liquids used are commonly salt water or mixed halogenated solvents in order to match the density of the resin or powder. To dispense the resin, a premeasured volume of the slurry is drawn into a pipette tip or similar device, then transferred to the desired location. A significant disadvantage of using an isobuoyant solution is that the density and uniformity of the slurry can vary as the liquid evaporates, so that the resin content for any given volume of slurry can be different from that in other slurry volumes. For example, as the ratio of resin to solution increases, volumetric dispensing provides an increasing amount of resin for a given volume of slurry, resulting in different loading capacities for different containers that are filled using the slurry. When salt water is used, residual salt must be washed off of the resin. Halogenated solvents can be incompatible with plastics and may have properties that are not desirable with the resins or powders, such as causing the particles to swell. Swollen resins can be fragile and may also be difficult to load into containers that are just big enough to hold them in their swollen state.

For the reasons described above, there remains a need for a resin dispenser that allows for an automated method of dispensing resin in a quick, efficient, and accurate manner.

SUMMARY OF THE INVENTION

It is an advantage of the present invention to provide a resin dispenser and method for dispensing resin in an accurate and repeatable manner based upon resin volume.

Another advantage of the present invention is to provide a resin dispenser and method for dispensing that significantly reduces the amount of resin spilled or otherwise lost during dispensing.

Still another advantage of the present invention is to provide a resin dispenser and method that allows resin to be supplied to the dispenser device in a manner that minimizes damage to the resin.

Yet another advantage of the present invention is to provide a resin dispenser that can accurately dispense pre-functionalized or other sticky resins that tend to clump together.

In an exemplary embodiment, the resin dispenser comprises a support frame, a probe or pipette-like device mounted on the support frame and connected to a vacuum source, a hopper for containing a resin slurry, a holder for retaining one or more containers to be loaded at a loading position, a translation means for moving the pipette tip from the hopper to the container, a fluid circulation pump and an air pump for circulating fluid in the hopper, and at least one control device. The hopper includes a means for continuous circulation and replenishment of solvent with a large reserve of resin, and has a small volume from which the resin is extracted.

The method for dispensing comprises drawing resin from a dispenser trough in the hopper into the loading volume using a vacuum, moving the probe to the loading position, then activating an air actuator which expels a resin pellet from the probe into the container by initiating movement of the inner and outer tubes that define the loading volume. By drawing the resin into the loading volume under vacuum against a frit or mesh, the resin becomes packed, providing an accurate volumetric measure of the resin itself rather than attempting to dispense an accurate and repeatable amount of resin based on measured volume of slurry.

The probe comprises an inner tube disposed within an outer tube. The inner tube is connected at its proximal end to a vacuum source to permit a vacuum to be drawn through the inner tube. A frit or mesh is disposed at the distal end of the inner tube to define the upper wall of the loading volume and to prevent resin from being pulled up into the tube while the vacuum is being drawn. Because solvent is drawn into the loading volume along with the resin, the vacuum system preferably includes a connection to a waste trap or appropriate container to receive the excess solvent and prevent suction of the solvent into the vacuum pump. Also, by pulling a vacuum on the resin, it becomes packed, providing a repeatable and accurate volumetric measure of the resin. The inner tube is axially movable relative to the outer tube to define the loading volume within the distal end of the outer tube within which resin can be drawn. The loading volume is adjustable by way of a micrometer which is used to adjust the spacing between an upper block, to which the proximal end of the inner tube is attached, and a lower block, to which the proximal end of the outer tube is attached. The upper and lower blocks are biased apart by a spring disposed around the micrometer. An air-controlled actuator is disposed between the upper and lower blocks to provide vertical movement to position the probe end for drawing slurry into the loading volume and also to provide sudden movement of the probe for dispensing. For dispensing, a stop located within a sleeve surrounding the outer tube interacts with a ring or pegs extending from the outside of the outer sleeve to suddenly stop movement initiated by the actuator. The resulting shock force causes the inner tube and frit to move relative to the outer tube so that the ends of the inner and outer tubes are substantially even, reducing the loading volume to zero. Thus, the interaction of the wet resin and the outer tube is negated, and the change in momentum between the resin and the frit or mesh is sufficient to overcome the attraction of the resin to the frit, effectively throwing the bulk of the resin from the loading volume and out into the target container.

In an exemplary embodiment, translation of the probe assembly, including the sleeve, probe and upper and lower blocks, between the hopper and loading position is effected by attaching the probe assembly to a slide block which is slidably mounted on a pair of slide rails. Movement of the slide block is provided via a motor-driven pulley system which moves the slide block laterally back and forth between the hopper and the loading position. The pulley system is mounted on the top of the support frame. Alternatively, one of the slide rails can be a rotating drive screw which interacts with a threaded inner diameter within the slide block to provide side-to-side movement. A pivoting movement can also be used, where the probe assembly is mounted on an arm that swings about an axis, and the hopper and loading position are positioned at equal radii so the arm can swing from one point to the other. Other alternative translation means will be apparent to those of skill in the art.

In an exemplary embodiment, the target container is retained within a holder mounted in a turntable that can hold a plurality of containers. As each container is filled with resin, the turntable increments to the next position to restart the loading sequence. The containers can also be presented to the dispenser head on a conveyor belt, a retractable tray, or any similar device that can hold and transport containers.

In the exemplary embodiment, the hopper is connected to the frame in a fixed position to ensure that the probe is able to repeatably target the correct location in the hopper. The hopper is a liquid-tight container with a plurality of channels for directing flow of air and solvent. The main reservoir has a sloped bottom so that resin particles settling from the suspension are guided to an opening at the bottom. The channels terminate at a location just below the opening in the bottom of the main reservoir where they merge to create an upward flow in a lift channel, so that the fluid and air bubbles carry the resin particles upward through the lift channel. Near the top of the lift channel the fluid and resin particles enter a horizontal channel which is connected to an inlet of the dispenser trough. The dispenser trough retains a small volume of slurry into which the probe tip can be placed to pick up the slurry for dispensing. The continuous feed of slurry into the dispenser trough ensures that the dispenser trough remains full. On the downstream side of the dispenser trough, excess resin spills back into the reservoir due to the higher specific gravity of the resin relative to the solvent. Thus, a constant level of slurry is maintained in the dispenser trough, which level is lower than the level of solvent in the main reservoir. An outlet is provided at the top sidewall of the reservoir for gravity spillover of solvent at a height which provides a constant level of solvent just above the level of resin in the dispenser trough. Solvent can then be recirculated back into the reservoir. A partial vertical barrier separates the dispenser trough from the solvent outlet to prevent resin from flowing out of the solvent outlet.

Once the slurry is drawn up into the loading volume of the probe, a vertical surface, such as a sidewall of the dispenser trough, can be used in conjunction with a short perpendicular translation of the translation means to scrape off excess resin that may extend below the edges of the probe tip, leveling off the resin in the loading volume of the probe to provide a measured amount of the resin.

In the exemplary embodiment, the solvent used to create the slurry is of a lesser density than the resin so that the resin will predominately settle to the bottom of the main reservoir. The solvent can be water but will preferably be methanol, any alcohol, acetonitrile, or non-polar based solvent such as hexane or heptane. Selection of the solvent will depend on the type of resin to be used. The solvents mentioned are preferred for polystyrene if no swelling is desired, since rigid, non-swollen resin may pack better into the loading volume and may fit better in the target container. In alternative embodiments, an isobuoyant solution of resin and solvent can be used, or the solvent can have a greater density than the resin, so that the resin floats at the top of the liquid.

A solvent circulating pump is provided to maintain a continuous flow of solvent through the reservoir, thus compensating for losses of solvent when slurry is removed and from evaporation of the solvent. The solvent is circulated through a solvent loop which includes appropriate tubing, the circulating pump and a solvent reservoir. A solvent overflow outlet is formed in the main reservoir at a level corresponding to the desired liquid level, so that excess solvent above the desired level will flow out and back to the solvent reservoir. As long as the circulating pump is active, the solvent level in the main reservoir will be at the optimal level for maintaining a layer of solvent above the resin in the dispenser trough. A peristaltic pump can be used to provide both the liquid circulation and the air flow, however, separate pumps may be used for each function. The liquid flow and air flow rates are adjusted for optimal slurry density and slurry delivery rate to the dispenser trough.

The resin dispenser includes at least one control device for controlling the translation means, the pick-up and dispensing of resin by the probe, and the feeding device for feeding containers to the loading position. The controller can include a microprocessor and memory and any interfaces needed for communicating with the various components that are to be controlled.

In an exemplary implementation, a mixture of solvent and resin are added to the reservoir chamber. The aerating pump injects air into the air channel while the circulating pump pumps recirculated liquid from the solvent reservoir into the solvent circulation channel. The air and liquid merge into the mixing volume just below the opening in the lower end of the main reservoir. Resin particles are fed from the reservoir opening into the mixing volume where they are picked up by the flowing solvent and air bubbles and carried up the lift channel then fed into the dispenser trough. The air bubbles continue up and out the top of the lift channel. Any excess resin not picked up by the upward flow will fall back into the mixing volume so that a uniform amount of resin is supplied to the dispenser trough. The gentle lifting provided by the upward flow avoids damaging the resin, which frequently occurs in mechanical handling techniques. The dispenser trough overflow area allows excess resin and liquid to flow back into the reservoir chamber.

Containers to be filled are placed on a turntable in holders that firmly hold them in place. The turntable is rotated to position a container at the loading position. The translation means moves the probe to a position above the dispenser trough containing a mixture of resin and solvent. The probe is moved downward by the air actuator so that the probe is at the liquid level of the trough. A vacuum is applied through the inner tube of the probe causing resin to be drawn out of the trough and held against the mesh at the distal end of the inner tube. Any solvent drawn up with the resin is directed to an outside container for storage. The probe is lifted a short distance and moved a short distance across a scraper positioned above the reservoir to scape off any excess resin which then falls back into the reservoir. If desired, the probe can be moved another short distance and the distal end dipped in the solvent in the main reservoir to rinse excess resin from the outside of the probe.

The translation means moves the probe to the dispensing loading position directly above a container. Dispensing action begins with the outer tube being pushed downward by providing air to the air actuator. The vacuum to the inner tube would be turned off before or at the start of dispensing. Movement of the outer tube will stop suddenly when the limit prongs contact the dispenser sleeve limit prongs. As the outer tube reaches it downward limit, the inertia causes inner tube to move downward, compressing the spacing spring and causing the probe to expel the resin into the container. After the resin is dispensed, the probe is raised and moved back to the hopper for reloading.

BRIEF DESCRIPTION OF THE DRAWINGS

Understanding of the present invention will be facilitated by consideration of the following detailed description of a preferred embodiment of the present invention taken in conjunction with the accompanying drawings, in which like numerals refer to like parts and in which.

DETAILED DESCRIPTION OF THE PREFERRED EMBODIMENTS

Figure 1:
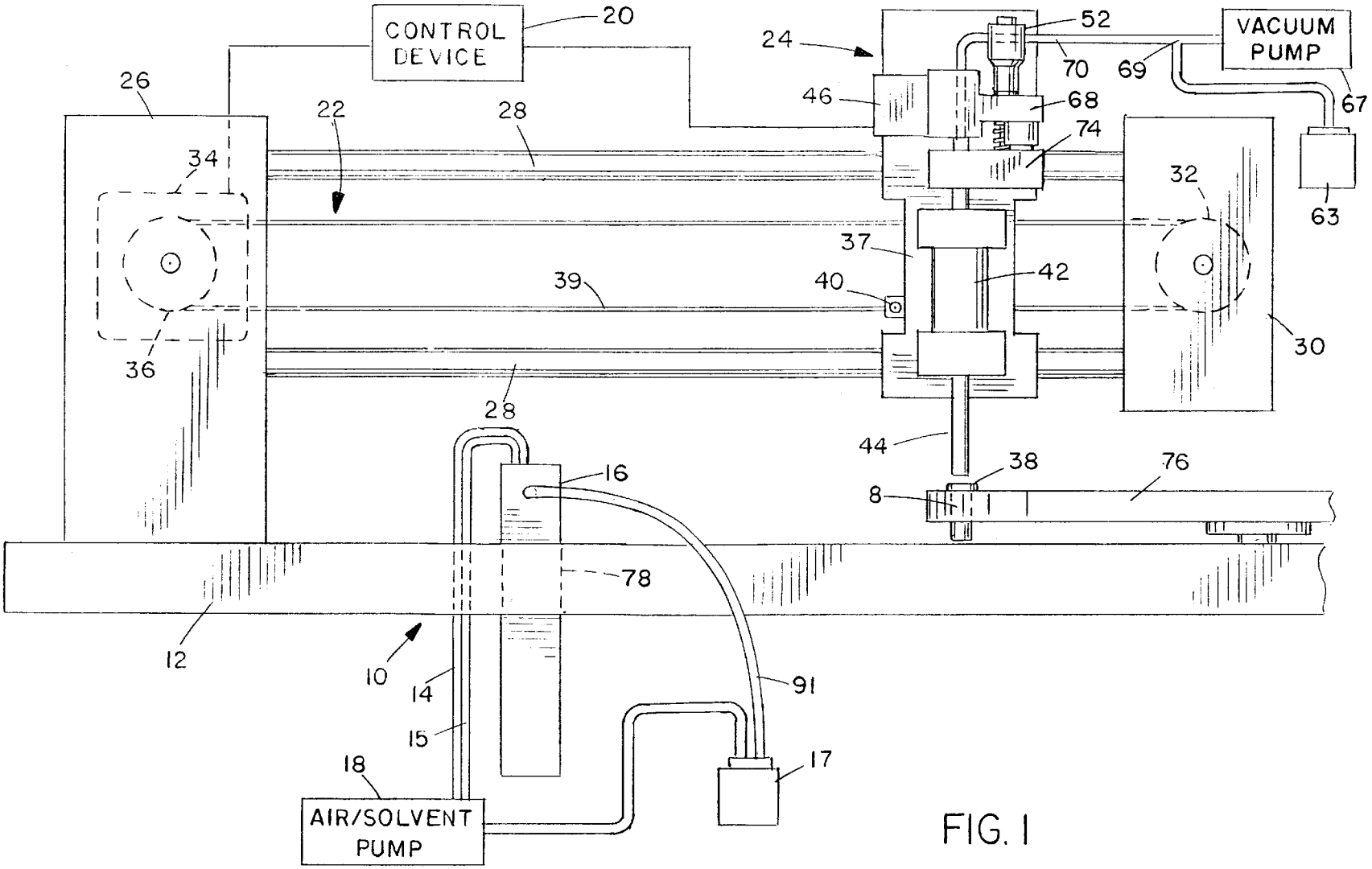
FIG. 1 is a side view of the resin dispenser.

As illustrated in FIG. 1, in the preferred embodiment, the resin dispenser 10 comprises a support frame or stage 12, a dispenser head 24, a hopper 16, at least one pump 18 for circulating solvent and air, a container holder 8, and at least one control device 20. Resin dispenser 10 also includes a translation means 22, which in the preferred embodiment is a pulley system, which provides for side-to-side movement of the dispenser head 24 back and forth between hopper 16 and dispensing position 8, as well a providing small translational motion for performing functions involved in the loading and dispensing steps. It should be noted that while the description of the preferred embodiment refers to "resin", the invention is equally applicable to other types and configurations of particulate materials which one may wish to dispense in precisely measured volumes into small containers. Such particulate materials may include beads or powders, including particulate solid supports made of glass, ceramic, or other appropriate materials in addition to conventional resin materials, which include, but are not limited to, polystyrene, polyacrylamide, kieselguhr, polyethylene glycol, and composites thereof.

Figure 2:
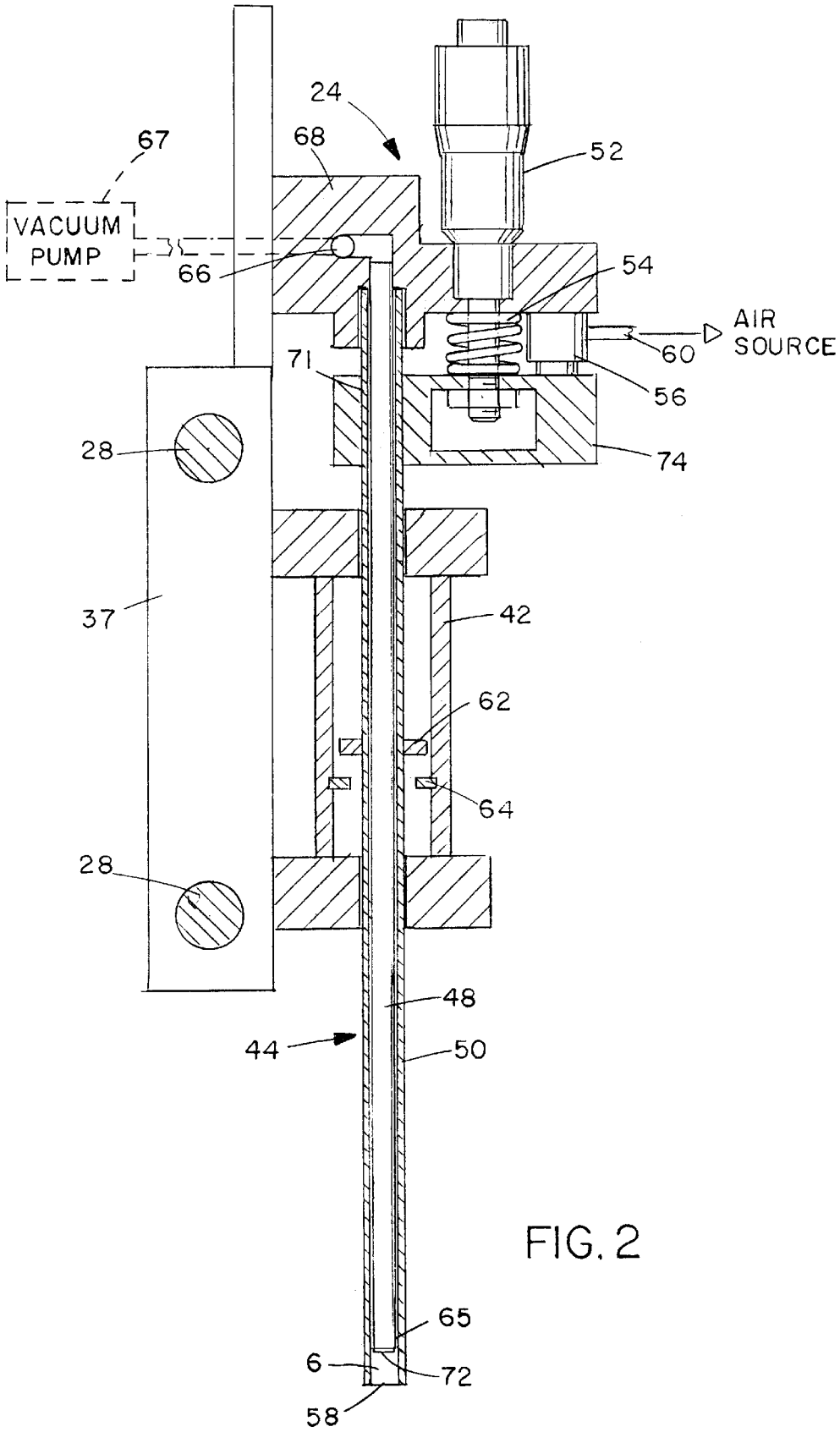
FIG. 2 is a detailed view of the dispenser head.

As illustrated in FIG. 2, dispensing head 24 includes probe 44 which comprises an inner tube 48 disposed within an outer tube 50 disposed with dispenser sleeve 42. Outer tube 50 and inner tube 48 are preferably made of stainless steel or a similar corrosive resistant material. Inner tube 48 is connected at its proximal end 66 to a vacuum pump 67 to permit a vacuum to be drawn through inner tube 48. A frit 72, stainless steel mesh or other appropriate filter is disposed at distal end 65 of inner tube 48 to define the upper boundary of loading volume 6 and having pore sizes sufficiently small to prevent resin from being pulled up into the tube while the vacuum is being drawn. Because solvent is drawn into loading volume 6 along with the resin, vacuum line 70 preferably includes a T-connection 69 to a waste collection container 63 (shown in FIG. 1) to receive the excess solvent and prevent suction of the solvent into vacuum pump 67. Alternatively, T-connection 69 can be connected via tubing (not shown) to solvent reservoir 17 for more efficient usage of solvent and to minimize the amount of potentially hazardous waste products that are generated. Vacuum pump 67 should provide a relatively strong vacuum to allow the resin to become tightly packed within loading volume 6 to form a pellet.

In the preferred embodiment, inner tube 48 is axially movable relative to outer tube 50 to define loading volume 6 within distal end 58 of outer tube 50 within which resin can be drawn. Loading volume 6 is adjustable by way of a micrometer 52 which is used to adjust the spacing between an upper block 68, to which the proximal end 66 of inner tube 48 is attached, and a lower block 74, to which the proximal end 51 of outer tube 50 is attached. Generally, the loading volume is sufficient to hold in the range of 2–10 mg of resin, however, much larger and smaller volumes are possible. An alternate means for adjusting and measuring the distance between the upper and lower blocks includes a lockable slide with increments indicated on the slide to allow the user to move the block apart by a pre-determined separation. Numerical indicators of the separation can be standard units, e.g., millimeters, from which the user can calculate or use a look-up table to determine the volume corresponding to the measured separation. Alternatively, using the known inner diameter of outer tube 50, an actual volume readout can be provided by calibrating the measurement device for volume corresponding to a given separation.

The upper and lower blocks 68 and 74 are biased apart by spring 54 disposed around the stem of micrometer 52. An air-controlled actuator 56, i.e., a pneumatic piston, is disposed between the upper and lower blocks 68 and 74 to provide a sudden downward movement of lower block 74 and, thus, outer tube 50, when air is supplied through air line 60 which is connected to an air source, such as a compressed air cylinder (not shown). A stop 64, attached to the inner wall of sleeve 42, interacts with a ring 62 or pegs attached to and extending from the outside of outer sleeve 50 to suddenly stop the movement initiated by actuator 56, thus causing a shock force which effectively throws the resin from loading volume 6 and out into the target container. The sudden downward motion of lower block 74 causes spring 54 to rapidly expand and pull down suddenly on upper block 68 which causes inner tube 48 to move downward. The rapid acceleration of upper block 68 compresses spring 54, reducing the spacing between upper block 68 and lower block 74, which, in turn, reduces the separation between the distal end 65 of inner tube 48 and the distal end 58 of outer tube 50, reducing the loading volume to substantially zero and causing the resin to be expelled from probe 44. Because the resin is still at least slightly wet with solvent, it is transferred as a pellet, which results in less loss of resin due to "stray" particles or static.

In an alternate embodiment, inner tube 48 and outer tube 50 are fixed relative to each other, and loading volume 6 is constant. However, loading volume 6 can be changed by replacing probe 44 with a different assembly of inner and outer tubes with different spacings at their distal ends. In the fixed embodiment, air actuator 56 initiates movement of probe 44 relative to sliding block 37 and sleeve 42. As in the embodiment described above, motion is abruptly stopped by contact between stops 62 and 64 which causes the resin pellet to be thrown from loading volume 6 into container 38.

In an exemplary embodiment, translation of the dispenser head 24, including the sleeve 42, probe 44 and upper and lower blocks 68 and 74, between hopper 16 and the loading position at container holder 8 is effected by attaching dispenser head 24 to slide block 37 which is slidably mounted on a pair of slide rails 28. In order to provide greater accuracy in transferring the resin, motor 46 can be provided to move dispenser head upward and downward along a short range of travel to facilitate access to resin in hopper 16 and position the end of probe 44 close to container 38. Where motor 46 is used, it is located between slide block 37 and dispenser head 24, specifically upper block 68. Motor 46 can be a stepper motor or other appropriate type of bi-directional motor. Movement of slide block 37 back and forth between the hopper and the loading position is provided via a motor-driven pulley system comprising pulleys 32 and 34 disposed at opposite ends of the travel, pulley motor 34, and cable 39, which connects to slide block 37 at connector 40. As shown, pulley motor 34, enclosed under cover 26 is connected to pulley 36 to pull cable 39. Pulley 32 is enclosed under cover 30. In addition to guard against inadvertent contact with the pulleys, covers 26 and 30 act as limits to the travel of slide block 37. Motor 34 may be a stepper motor or other appropriate reversible motor. Selection of an appropriate motor will be apparent to one of skill in the art. In the preferred embodiment, motor 34 is activated by commands from controller 20.

Alternate translation means includes substituting one of the slide rails with a motor-driven screw which interacts with a threaded inner diameter within the slide block to provide side-to-side movement. A chain-drive can be used, where the cable is replaced by a chain and toothed wheels are used in place of the pulleys. A pivoting movement can also be used to move dispensing head 24 from hopper 16 to loading position 8 by mounting dispensing head 24 on an arm that swings about an axis. Hopper 16 and loading position 8 are positioned at equal radii from the axis of rotation so the arm can swing from one point to the other. Other alternative translation means will be readily apparent to those of skill in the art.

Frame 12 will preferably be made of stainless steel or a molded aluminum, and may be coated or treated to enhance resistance to corrosion from any solvents that might be used.

In an exemplary embodiment, target container 38 is retained within a container holder 8 disposed in or on turntable 76 that can hold a plurality of containers. Container holder 8 is connected to a vacuum pump (not shown) which is activated to hold the container 38 in place until the vacuum is deactivated. As each container 38 is filled with resin, turntable 76 increments to the next position to restart the loading sequence. The containers can also be moved into position for receiving resin from the dispenser head using a conveyor belt, a retractable tray, or any similar device that can hold and transport containers. Implementation of means for feeding a sequence of containers to be loaded with resin is within the level of skill in the art. A mass balance or other weighing means can be positioned below the turntable or other feeding means to indicate the total weight change each time a container is filled, allowing the weight of the dispensed resin to be monitored and recorded.

Because the resin dispensed into the container 38 is slightly wet with solvent, it may be desirable to provide a drying station (not shown) that is accessible by rotating turntable 76. The turntable rotation moves container 38 from the loading position to the drying station, where a heat lamp is directed onto the container 38 to dry the resin. Any need for drying station will depend on the type of resin and solvent used. In the exemplary embodiment, in which the solvent is methanol, at room temperature, it can take about 15 minutes to dry. The drying time can be accelerated by increasing the temperature a few degrees. After drying, container 38 is moved to a capping station, where the container is sealed with the resin inside.

In the exemplary embodiment, hopper 16 is connected to frame 12 in a fixed position to ensure that probe 44 is able to repeatably target the correct location in hopper 16. Stabilization of hopper 16 within frame 12 is particularly appropriate due to the vibration that may be transferred to frame 12 when resin is being dispensed.

Hopper 16 is a liquid-tight container with a plurality of channels 84, 86, and 88 for directing the flow of solvent and air. Main reservoir 82 has a sloped bottom 83, in a conventional hopper configuration, so that resin particles settling from the solvent suspension are guided to the lowest point in the reservoir where an opening 96 is located. Air and solvent input channels 86 and 84 terminate at mixing volume 85 just below opening 96 in the bottom of main reservoir 82 where the flows merge to create an upward flow in lift channel 88, so that the fluid and air bubbles 97 carry the resin particles upward through lift channel 88. Near the top of lift channel 88, where the solvent level is slightly higher than in main reservoir 82, the solvent and lifted resin particles flow into horizontal channel 89 which is connected to the inlet of dispenser trough 98. Dispenser trough 98 retains a small volume of slurry 99 above which probe tip 44 is positioned to pick up the slurry for dispensing. The continuous feed of solvent and resin into dispenser trough 98 ensures that there is a steady supply of slurry 99. An overflow 100 is provided on the downstream side of dispenser trough 98. Due to the higher specific gravity of the resin relative to the solvent, overflow 100 allows excess resin to spill back into main reservoir 82, thus maintaining a constant level of slurry 99 in dispenser trough 98. The level of slurry 99 is slightly lower than the level of solvent in main reservoir 82. Barrier 101 is provided to prevent any excess resin from inadvertently being carried out through solvent overflow 92. Once the slurry is drawn up into the loading volume 6 of probe 44, a vertical surface, such as a sidewall 93 of dispenser trough 98, can be used in conjunction with a short perpendicular translation of the translation means to scrape off excess slurry that may extend below the edges of the probe tip, leveling off the slurry in the loading volume 6 of the probe to ensure that each load of resin has the desired volume of material.

Multiple hoppers 16 may be used to permit the selection of different types of solid supports, to provide an even larger reserve of resin to load a larger quantity of containers, or to provide a supply of dry resin which will can also be dispensed using the probe as described. One or more extra slots 78 are formed in frame 12 and, for slurry dispensing, the solvent and air circulation can be provided via a separate pumping system or the additional hoppers can be connected to T-connections coming off of the existing solvent and air pumping systems.

Figure 4:
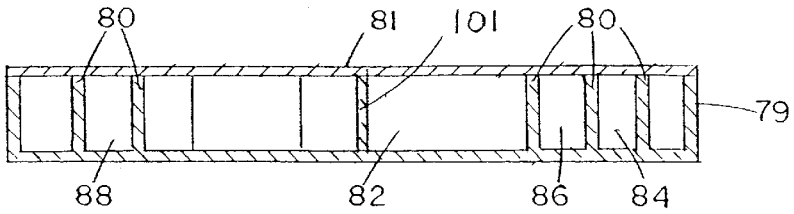
FIG. 4 is a cross-sectional view taken along line 4—4 of FIG. 3.

In the preferred embodiment, hopper 16 is a rectangular structure that is generally flat in profile, formed by assembling a front plate and a back portion with a plurality of molded ridges or dividers 80, as illustrated in FIG. 4. When front plate 81, which is preferably a clear acrylic, Lexan®, or similar material, is attached to the back portion 79, main reservoir 82, channels 84, 86 and 88, dispenser trough 98, and other features are defined. Back portion 79 is molded or machined, and can be made from aluminum, stainless steel, or other appropriate metal, or can be formed from an appropriate plastic or polymer. It may be desirable to include a seat and rubber or silicone seal around the sides and bottom of back portion 79 to ensure a liquid-tight seal when front plate 81 is attached via screws or other fasteners to back portion 79. Alternatively, front plate 81 can be glued to back portion 79 using an appropriate adhesive, such as silicone or epoxy. Alternate embodiments for hopper 16 include a beaker, tub or similar container with the channels provided by tubing and the main reservoir formed by placing a funnel or funnel-shaped device within the container. Adaptation of various containers to provide the elements of the hopper, i.e., the main reservoir, channels and dispensing trough, will be readily apparent to those of skill in the art.

In the exemplary embodiment, the solvent used is of a lower density than the resin so that the resin will generally settle to the bottom 83 of main reservoir 82. The preferred resin is polystyrene, and the solvent used is methanol. In order to avoid swelling of the beads, the solvent can be water, methanol or other alcohol, or acetonitrile, and non-polar solvents such as hexane, heptane, and ether. Selection of the solvent will depend on the type of linkers that are to be used, e.g., non-polar solvents are needed for polar linkers. Where swelling is not a concern, for example, where the solid supports are glass or ceramic beads, other solvents may be used. Generally, selection of an appropriate solvent will be within the level of skill in the art. In alternative embodiments, an isobuoyant solution of resin and solvent can be used, or the solvent can have a greater density than the resin, so that the resin floats at the top of the liquid.

Figure 3:
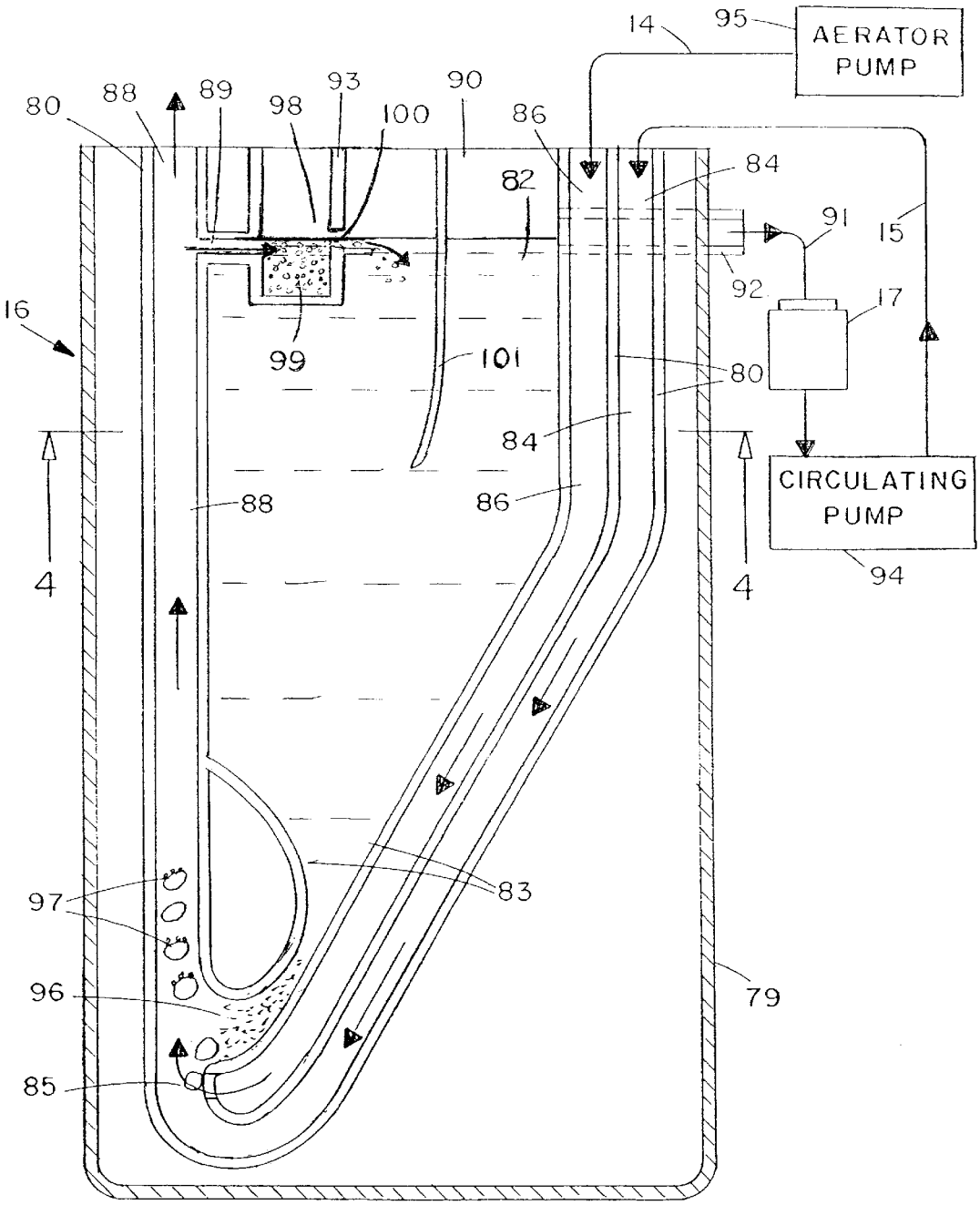
FIG. 3 is a detailed view of the hopper.

Referring again to FIG. 3, solvent circulating pump 94 maintains a continuous flow of solvent through main reservoir 82, thus compensating for losses of solvent when slurry is removed and from evaporation of the solvent. The solvent is circulated through a solvent loop which consists of tubing 15 and 91, circulating pump 94 and solvent reservoir 17, along with various connectors. Solvent overflow outlet 92 is formed in main reservoir 82 at a level corresponding the desired liquid level so that excess solvent above the desired level will flow out and back to solvent reservoir 17. As long as circulating pump 94 is active, the solvent level in main reservoir 82 will be at the optimal level for maintaining the desired slurry consistency. Air pump 95 is connected via air tubing 14 to channel 86. In the preferred embodiment, the functions of air pump 94 and circulating pump 95 are combined in a single peristaltic pump, which is shown in FIG. 1 as pump 18, which can provide both the liquid circulation and the air flow through the appropriate tubing, however, separate pumps may be used for each function, as shown in FIG. 3.

The resin dispenser includes at least one controller 20 for controlling one or more of the translation means 22, the pick-up and dispensing of resin by probe 44, and the feeding device 76 for feeding containers to the loading position. Controller 20 can be a simple switch for turning one of the components on or off at the appropriate time, however, in the preferred embodiment controller 20 controls all functions of the system. The controller 20 can include a microprocessor and memory and any interfaces needed for communicating with the various components that are to be controlled.

In an exemplary implementation, solvent is introduced into the main reservoir by activating circulating pump 94, pulling solvent from solvent reservoir 17 and feeding it into solvent channel 84. The user pours enough resin for loading a large number of containers into the solvent in the main reservoir 82. This large reserve of resin allows continuous automated dispensing of resin into a large quantity of containers in a single operating cycle. Aerating pump 95 injects air into air channel 86 to create bubbles in the solvent. The air and liquid merge into the mixing volume 85 just below the opening 96 in the lower end of main reservoir 82. Resin particles are gravity-fed from the reservoir opening 96 into the mixing volume 85 where they are picked up by the flowing solvent and air bubbles 97 and carried up lift channel 88 to the surface of the solvent in lift channel 88 where the solvent and resin are fed, i.e., spill, into the dispenser trough 98 through horizontal channel 89. Air bubbles 97 continue up and out the top of lift channel 88. Any excess resin not picked up by the upward flow will fall back into the mixing volume 85 so that a uniform flow of resin is supplied to dispenser trough 98. The gentle lifting provided by the upward flow avoids damaging the resin, which frequently occurs in mechanical handling techniques. A slurry 99 of solvent and resin is formed in dispenser trough 98. Within dispenser trough 98, slurry 99 has a level that is lower than the level of solvent in the main reservoir 82, thus allowing excess resin to easily exit via dispenser trough overflow 100 and fall back into main reservoir 82.

Containers to be filled are placed on turntable 76 in holders 8 that firmly hold them in place. Turntable 76 is rotated to position a container 38 at the loading position. Translation means 22 moves probe 44 to a position above dispenser trough 98, which contains a mixture of resin and solvent. Although vertical movement of probe 44 is not necessary, accuracy is improved by moving probe 44 downward using positioning motor 46 so that the probe is at or just above the liquid level of trough 98. A vacuum is applied through inner tube 48 of probe 44 causing resin to be drawn out of trough 98 and into loading volume 6, where it is pulled against the frit 72 at the distal end 65 of inner tube 48. Any solvent drawn up with the resin is directed to solvent reservoir 17 for recycling or to container 63 for collection for later disposal. Probe 44 is lifted a short distance and laterally moved a short distance across sidewall 93 of dispenser trough 98 to scape off any excess resin. If desired, probe 44 can be laterally moved another short distance and the distal end dipped in the solvent in main reservoir 82 to rinse excess resin from the outside of probe 44.

For the embodiment of FIG. 1, pulley motor 34 is activated, turning pulleys 36 and 32 and cable 39 in a counter-clockwise direction, moving probe 44 to the loading position on turntable 76. Probe 44 is moved to the downward position so that its end is directly above a container 38 at the loading position. Dispensing action begins with outer tube 50 being pushed downward by activating air actuator 56 at the same time that the vacuum to inner tube 48 is turned off. Movement of outer tube 50 will stop abruptly when the limit ring 62 contacts the dispenser sleeve stop 64. As outer tube 50 reaches its downward limit, the inertia causes inner tube 48 to move downward, compressing spacing spring 54 and causing the distal end 65 of inner tube 48 to expel the resin from loading volume 58 and into container 38. After the resin is loaded into container 38, probe 44 is raised and moved back to hopper 16 for reloading by reversing motor 34 to rotate pulleys 36 and 32 and cable 39 in a clockwise direction. The turntable 76 is rotated to present the next container at the loading position for receiving the next load of resin.

In an alternate embodiment for dispensing of dry particulate material, a turntable positioned below a hopper containing the particulate materials, as is known in the art, is used to provide a continuous supply of the particulate material. Briefly, the hopper has a funnel at its bottom which feeds the particulate material into a channel or trough formed in the top surface of a horizontal turntable. A stationary scraper extends over the channel to maintain a constant level of material in the channel. The distal end of a probe, as illustrated in FIG. 2, is positioned above the channel an lowered to allow the vacuum drawn through the probe to draw the particulate material into the loading volume. The probe is moved to a position above the container to be filled and the air actuator is activated to expel the particulate material from the loading volume into the container as previously described. Other methods for providing a continuous supply of resin or other particulate material to the probe tip may be used.

The resin dispenser and method of using the present invention provides many advantages over devices and methods currently available for dispensing. Because the dispenser creates a resin pellet, there is less mess and less loss of resin. Repeatability and precision are improved over prior art methods because there is no random resin loss due to static or vacuum retention. Further, there is no loss of resin in reservoir from static dispersion. Automation is made possible because there are fewer environmental variables to control, such as room humidity and air currents. Also, the hopper permits the loading of large resin reserves to provide longer run times. Circulation of the resin by continuous solvent flow and bubble transfer of the resin to the dispensing trough are non-destructive. Solvent replacement is automatic and solvent and slurry levels are controlled by passive overflow.

It will be apparent to those skilled in the art that various modifications and variations may be made in the apparatus and process of the present invention without departing from the spirit or scope of the invention. Thus, it is intended that the present invention cover the modification and variations of this invention provided they come within the scope of the appended claims and their equivalents.

We claim:

1. An apparatus for dispensing particulate material into a container, the apparatus comprising:

a frame;

a probe movably disposed on the frame, the probe comprising an inner tube disposed within an outer tube, each tube having a distal end, the distal ends being spaced apart to define a loading volume, wherein the distal end of the inner tube has a filter having a pore size smaller than the particulate material;

a vacuum source connected to the inner tube for drawing particulate material into the loading volume;

a supply of particulate material disposed at a location accessible by the distal end of the outer tube, the supply being substantially continuous;

a container holder disposed at a loading position for holding the container;

a translator for moving the probe between a hopper to the container in the container holder;

an actuator for effecting vertical movement of the outer tube and the inner tube;

a controller for controlling activation of at least one of the probe, container holder, actuator, and translator; and wherein the inner tube is axially movable relative to the outer tube for adjusting volume in response to activation of the actuator to expel particulate material contained within the loading volume; and the inner tube is connected to an upper block and the outer tube is connected to a lower block, further comprising an adjustable measurement device for adjusting a separation between the upper block and the lower block.

2. The apparatus of in claim 1, further comprising a spring for biasing the upper block from the lower block.

3. The apparatus of claim 1, wherein the measurement device comprises a micrometer.

4. The apparatus of claim 1, further comprising a stop for limiting downward motion of the outer tube, wherein when the actuator is activated, downward motion of the outer tube is suddenly stopped to generate a shock force to expel particulate material contained within the loading volume.

5. The apparatus of claim 4, wherein the shock force causes the inner tube to move downward, reducing the loading volume to substantially zero.

6. The apparatus of claim 1, wherein the separation between the upper block and the lower block is reducible to reduce the loading volume to substantially zero to expel particulate material from the loading volume.

7. The apparatus of claim 1, wherein the translation means comprises a pulley system.

8. The apparatus of claim 1, wherein the supply of particulate material comprises a hopper disposed within the frame for containing a mixture of solvent and particulate material, the hopper having a main reservoir, and further comprising:

a solvent circulating system for circulating solvent in the hopper;

an aerating system for creating a plurality of bubbles in the solvent, wherein the plurality of bubbles lifts the particulate material to a surface of the solvent;

a dispenser trough disposed within the hopper for receiving the particulate material and solvent to create a slurry within the dispenser trough, the dispenser trough having a slurry overflow for returning the particulate material to the main reservoir of the hopper.

9. The apparatus of claim 8, wherein the particulate material has a density greater than the density of the solvent, and the main reservoir of the hopper has an opening formed at its bottom for feeding particulate material to a mixing volume for combining with circulating solvent and the plurality of bubbles.

10. The apparatus of claim 9, wherein the bottom of the main reservoir is sloped to direct the particulate material to the opening.

11. The apparatus of claim 8, further comprising a solvent overflow for maintaining a level of solvent in the hopper above a level of slurry in the dispenser trough.

12. The apparatus of claim 8, wherein the solvent circulating system comprises a circulating loop including a circulating pump and a solvent reservoir, wherein solvent is continuously circulated during operation of the apparatus.

13. The apparatus of claim 8, wherein the solvent circulating system and the aerating system include a peristaltic pump for pumping solvent and air in the solvent circulating system and the aerating system, respectively.

14. The apparatus of claim 8, wherein the hopper comprises a flat front portion and a back portion having a plurality of ridges for forming a plurality of channels when the front portion is attached to the back portion.

15. The apparatus of claim 14, wherein the plurality of channels comprises a solvent circulating channel, an aerating channel, and a lift channel.

16. The apparatus of claim 8, wherein the particulate material is resin comprising a material selected from the group consisting of polystyrene, polyacrylamide, kieselguhr, polyethylene glycol, and composites thereof.

17. The apparatus of claim 16, wherein the resin is contained within a solvent and the solvent is selected to prevent swelling of the resin.

18. The apparatus of claim 17, wherein the solvent is selected from the group consisting of water, methanol, alcohol, hexane, heptane, ether, and acetonitrile.

19. An apparatus for dispensing particulate material into a container, the apparatus comprising:

a frame;

a probe movably disposed on the frame, the probe comprising an inner tube disposed within an outer tube, each tube having a distal end, the distal ends being spaced apart to define a loading volume, wherein the distal end of the inner tube has a filter having a pore size smaller than the particulate material;

a vacuum source connected to the inner tube for drawing particulate material into the loading volume;

a hopper disposed within the frame for containing the particulate material within a solvent, the hopper having a main reservoir;

a circulating system for circulating the solvent and particulate material in the hopper;

an aerating system for creating a plurality of bubbles, wherein the plurality of bubbles lifts the particulate material within a lift channel;

a dispenser trough disposed within the hopper for receiving the particulate material from the lift channel;

a container holder disposed on the frame for holding the container;

a translation means for moving the probe between the hopper to the container in the container holder; and a controller for controlling activation of at least one of the probe, container holder and translation means.

20. An automated method for loading particulate material into a container, the method comprising:

(a) adding an excess of the particulate material into a circulating solvent in a hopper;

(b) introducing air bubbles into the circulating solvent at a lower portion of the hopper;

(c) lifting the particulate material on the air bubbles to a dispensing trough;

(d) suspending a probe above the dispensing trough, wherein the probe comprises an inner tube within an outer tube, each tube having a distal end wherein the distal end of the outer tube extends beyond the distal end of the inner tube, the difference between the distal ends defining a loading volume, wherein the inner tube has a filter disposed at the distal end;

(e) drawing a vacuum through the inner tube to draw particulate material into the loading volume;

(f) moving the probe from the dispensing trough to a container;

(g) expelling the particulate material from the loading volume; and (h) controlling each of steps (b) and (e) through (f) with a computer controller.

21. The method in accordance with claim 20, wherein the particulate material is resin.

22. The method in accordance with claim 21, wherein the resin is selected from the group consisting of polystyrene, polyacrylamide, kieselguhr, polyethylene glycol, and composites thereof.

23. The method in accordance with claim 22, wherein the solvent is selected to prevent swelling of the resin.

24. The method in accordance with claim 22, wherein the step of expelling comprises generating vertical momentum in the probe and abruptly stopping the vertical momentum to throw the particulate material from the loading volume.

25. The method in accordance with claim 22, wherein the step of expelling comprises moving the inner tube within the outer tube to reduce the loading volume to substantially zero.

26. The method in accordance with claim 22, wherein the solvent is selected from the group consisting of water, methanol, alcohol, hexane, heptane, ether, and acetonitrile.

27. An automated method for loading particulate material into a container, the method comprising:

(a) supplying a substantially continuous supply of the particulate material;

(b) suspending a probe above the continuous supply, wherein the probe comprises an inner tube within an outer tube, each tube having a distal end wherein the distal end of the outer tube extends beyond the distal end of the inner tube, the difference between the distal ends defining a loading volume, wherein the inner tube has a filter disposed at the distal end;

(c) drawing a vacuum through the inner tube to draw particulate material into the loading volume;

(d) moving the probe from the dispensing trough to dispensing position above a container;

(e) activating an actuator to create a shock force which expels the particulate material from the loading volume and into the container;

wherein each of steps (b) through (e) is controlled with a computer controller.

28. The method in accordance with claim 27, wherein the substantially continuous supply of particulate material comprises a hopper disposed for containing a mixture of solvent and particulate material, the hopper having a main reservoir, and further comprising the steps of:

circulating the solvent and particulate material in the hopper;

creating a plurality of bubbles in the solvent, wherein the plurality of bubbles lifts the particulate material to a surface of the solvent;

receiving the particulate material and solvent within a dispenser trough to create a slurry from which the loading volume is filled; and returning excess particulate material via an overflow to the main reservoir of the hopper.

29. The method in accordance with claim 27, wherein the particulate material is resin.

30. The method in accordance with claim 29, wherein the resin is selected from the group consisting of polystyrene, polyacrylamide, kieselguhr, polyethylene glycol, and composites thereof.

31. The method in accordance with claim 29, wherein the solvent is selected to prevent swelling of the resin.

32. The method in accordance with claim 31, wherein the solvent is selected from the group consisting of water, methanol, alcohol, hexane, heptane, ether, and acetonitrile.

33. An automated method for loading particulate resin material into a container, the method comprising:

(a) supplying a substantially continuous supply of the particulate resin material wherein the substantially continuous supply of particulate resin material comprises a hopper disposed for containing a mixture of solvent and particulate resin material, the hopper having a main reservoir, and further comprising the steps of:

circulating the solvent and particulate resin material in the hopper;

creating a plurality of bubbles in the solvent, wherein the plurality of bubbles lifts the particulate resin material to a surface of the solvent;

receiving the particulate resin material and solvent within a dispenser trough to create a slurry from which the loading volume is filled; and returning excess particulate resin material via an overflow to the main reservoir of the hopper;

(b) suspending a probe above the continuous supply, wherein the probe comprises an inner tube within an outer tube, each tube having a distal end wherein the distal end of the outer tube extends beyond the distal end of the inner tube, the difference between the distal ends defining a loading volume, wherein the inner tube has a filter disposed at the distal end;

(c) drawing a vacuum through the inner tube to draw particulate material into the loading volume;

(d) moving the probe from the dispensing trough to a dispensing position above a container;

(e) activating an actuator to move the inner tube relative to the outer tube to reduce the loading volume to substantially zero to expel the particulate material from the loading volume and into the container;

wherein each of steps (b) through (e) is controlled with a computer controller.

* * * * *